United States Patent [19]

Lascarrou

[11] 4,009,507

[45] Mar. 1, 1977

[54] DOOR PIVOTING DEVICE

[75] Inventor: Alain Lascarrou, Epinay-sur-Seine, France

[73] Assignee: La Telemecanique Electrique, France

[22] Filed: Dec. 3, 1975

[21] Appl. No.: 637,258

[30] Foreign Application Priority Data

Dec. 17, 1974 France ..... 74.41482

[52] U.S. Cl. ..... 16/171; 16/149; 403/353

[51] Int. Cl.[2] ..... E05D 7/12

[58] Field of Search ..... 16/149, 181, 177, 171, 16/169; 403/353, 349, 322, 348, 354; 24/230 AV, 230 AS, 201 A

[56] References Cited

UNITED STATES PATENTS

| | | | |
|---|---|---|---|
| 755,311 | 3/1904 | Palmer | 16/149 |
| 1,496,466 | 6/1924 | Jackson | 16/174 X |
| 1,712,867 | 5/1929 | Beil | 16/177 UX |
| 3,853,414 | 12/1974 | Hirano | 403/349 X |

FOREIGN PATENTS OR APPLICATIONS

| | | | |
|---|---|---|---|
| 295,889 | 11/1969 | Australia | 16/171 |

*Primary Examiner*—Andrew V. Kundrat
*Attorney, Agent, or Firm*—William Anthony Drucker

[57] ABSTRACT

The invention relates to a pivoting device for a door or the like.

The door hinge is detachably fixed to the lower wall of the door, with which it can be made integral by rotating the lever fixed to the hinge by a quarter of a turn.

The present device can be used with particular advantage for dismantleable doors of metal cabinets containing electrical equipment.

4 Claims, 2 Drawing Figures

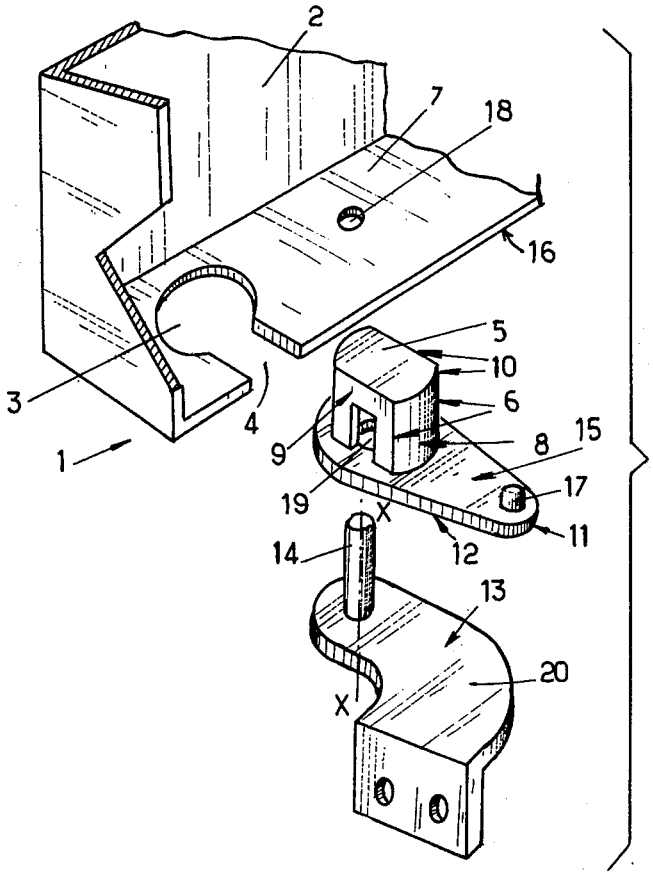
Fig. 1
Fig. 2
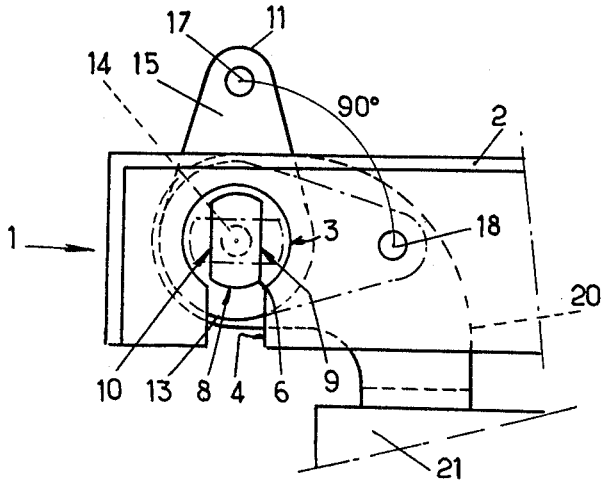

DOOR PIVOTING DEVICE

The invention relates to a pivoting device comprising at least one door hinge which in firstly fitted to a hinge pin permanently fixed to a frame and is then made integral with a door or an analogous pivoting member.

A device of this type is particularly advantageous for pivoting the doors of cabinets to be used for receiving electrical equipment arranged in a series of superimposed racks each being associated with one of the doors. It can also be used in apparatus where the electrical equipment is placed on a pivoting chassis.

Pivoting systems are already known which permit a fitting and removal of the movable portion by using a detachable door hinge which is, for example fixed to the door by screwing after fitting the said hinge to a hinge pin.

Besides having an unattractive appearance, these systems suffer from the disadvantage that the fixing members for the door hinges must be perfectly centred in order to ensure the alignment of the pivoting members which leads to either a high manufacturing cost or in the case where there is a decrease in the precision of manufacture to jamming or wear which are incompatible with the existing need to reduce maintenance.

Moreover, it frequently occurs with the prior art door hinges expose the fixing members externally of the door in such a way that a disassembly of the door in its closed position must be feared due to the presence of the live conductor behind its panel.

The invention therefore proposes to provide a pivoting system which has an attractive appearance and does not require the use of a high precision manufacturing tool.

According to a special embodiment, the invention also aims at providing a pivoting system which is burglarproof when the door is closed and when consequently the conductors behind the same are liable to be live.

Finally, the proposed device makes it possible to rapidly fit the pivoting member by means of simple inexpensive means.

According to the invention, the main object is achieved in that the area of the door which receives the pivoting device has an internal recess linked to an opening issuing on the surface of the door perpendicular to the pivoting axis, in that the door hinge has a projecting portion concentric to the axis of the bore receiving the hinge pin which after traversing the opening is positioned in the recess and in that the coupling means fixed to the first portion are made integral with the recess by a predetermined rotation relative to the recess of an operating means integral with the portion.

Other features of the invention can be gathered from reading the following description with reference to the drawings, wherein show:

FIG. 1, a perspective view of the various members of the pivoting device;

FIG. 2, is a plan view of the device with a partial cutting away of the door.

The area 1 of door 2 which receives the pivoting device shown in FIG. 1 is most frequently located in the lower and/or upper portions and close to an apex.

However, it is conceivable that a single device located at the bottom of the door is necessary when the pivoting means at the top is reduced to a pin which penetrates a recess.

In the embodiment shown the door is made from metal and consequently comprises a thin wall, but an analogous arrangement can be immediately worked out when the door which is required to receive the pivoting device is solid.

The hinge pin substantially comprises a cylindrical portion 14 of axis XX′ integral with a bearing surface 13 having a surface extension 20 and frame fixing means.

On the said hinge pin is pivoted a door hinge which substantially comprises a bore 19 made in a portion 5 which is integral with an operating means in the form of a lever 11 whose lower surface 12 is applied to the bearing surface 13 of the hinge pin, whilst its upper surface 15 receives the lower surface 16 of the door which is perpendicular to the axis XX′.

The portion 5 has a cylindrical revolution form 8 concentric to bore 19 whereon are made two flats 9 and 10 whose surfaces are parallel. These flats are separated by a distance equal to or greater than the diameter of bore 19 and are limited by edges 6.

The end of lever 11 has a lug 17 on its upper surface 15 which is located a certain distance from the bore axis.

The bore hinge is made from a material having a sufficient flexibility for the end of the lever 11 to be deflected parallel to axis XX′ by a quantity at least equal to the height of the lug.

The lower wall 7 of the door, perpendicular to the axis XX′, has a recess 3 of circular cross-section whose diameter is close to that of the cylindrical portion 8.

This recess 3 is connected to the outer edge of the wall by an opening 4 perpendicular to axis XX′ whose edges are parallel and separated by a distance close to that separating the two flats 9 and 10.

An indentation, notch or hollow 18 is made in wall 17 at a distance from the centre of the recess equal to that separating lug 17 from the axis of bore 19 of the hinge pin, and in a direction substantially perpendicular to the direction of opening 4.

The device is fitted in the following manner: the hinge pin or pins are firstly fixed to the front vertical wall of the cabinet 21 cf. FIG. 2, on which the door 2 is to be pivoted.

The door hinge is fitted to cylindrical rod 14 in such a way that the flats are positioned in a direction substantially perpendicular to the plane of the front face of the cabinet. The door is then presented in a position where flats 9 and 10 are aligned with opening 4 and is advanced by a quantity such that the portion 5 traverses opening 4 and is located in recess 3 in a position where the cylindrical surface 8 is supported on the edge of the said recess.

The end of lever 11 which projects beyond the door is then maintained in place whilst the door is given a rotary movement in counter-clockwise direction which causes a coupling of edges 6 and the cylindrical surface with the edges of the recess up to the time when the flats are located perpendicularly to the direction of opening 4. In the meantime the end of lever 11 has necessarily moved downwards parallel to the axis XX′ to permit the lug to pass beneath the surface 16 of the door until the latter latches in indentation 18 due to its elasticity, thereby ensuring the permanence of the coupling between door and hinge.

When the door is lowered into the position of FIG. 2 the hinge accompanies it in its movement and the lower surface 12 serves as a friction surface by bearing on the bearing surface 13 of the hinge pin.

In this position the extension of surface 20 which faces the end of the lever in such a way that it is impossible to obtain access thereto, and consequently bring about disassembly when the door is closed.

The device can only be disassembled when the door is open.

As per se known ancillary or obligatory measures are generally taken to prevent the opening of the door except when the switches have switched off the electrical equipment located behind it, the disassembly of the door can only taken place when the internal conductors are no longer live.

Obviously the device represented hereinbefore only forms a special embodiment and various modifications can be made thereto, and equivalent means provided without passing beyond the scope of the invention.

I claim:

1. An assembly of two relatively pivotable structures comprising in combination:

i. a first structure including two mounting means secured in spaced relationship and each having a bearing surface, the bearing surfaces being parallel to each other, and opposed, ii. two hinge pins each of which is secured on a respective mounting means and projects normally from the bearing surface thereof, said hinge pins being axially aligned and axially spaced from each other, and projecting towards each other, iii. a second structure including two walls each having a bearing face, said bearing faces being parallel, each such wall defining a part-circular recess and a parallel-sided channel opening at one end into said recess and opening at its other end at a free edge of said wall, iv. a hinge member including a bearing element and a stud, said bearing element having a bore to receive a hinge pin, said bearing element having a first face normal to the axis of said bore to abut on a respective bearing surface, said stud projecting from an opposed second face of said bearing element, said stud having two diametrically opposed first sidewall surface portions which are of greater radial separation about the axis of said bore than the width of said channel, said stud having two diametrically opposed second sidewall surface portions which are of lesser radial separation about the axis of said bore than the width of said channel v. means of said hinge member and on said second structure for retaining said hinge member releasably in a selected position of rotation of said stud in said part-circular recess, whereby, with each hinge engaged on a respective hinge pin in a first position of rotation with respect to a respective wall, the walls can each receive the stud passed through the channel into the part-circular recess by reason of the lesser separation of the second sidewall portions, whereafter rotation of the hinge member into a second position of rotation causes the stud to be locked in the part-circular recess by reason of the greater separation of the first side wall portions.

2. An assembly, as claimed in claim 1, wherein said retaining means comprises interengageable formation provided one on said bearing element and the other on said wall.

3. An assembly, as claimed in claim 2, wherein said retaining means comprises a porjection and a recess disposed one on the second face of the bearing element, and one on the bearing face of the wall, said projection and recess being at the same radial spacing respectively from the axis of the bore and from the axis of the part-circular recess.

4. An assembly, as claimed in claim 3, wherein said first structure is a door frame, and said second structure is a door, said first position of rotation being with the door open and said second position of rotation being with the door closed, the bearing element being sandwiched between the mounting and the wall in said second position, whereby said retaining means cannot be disengaged, and said hinge member cannot be released from said wall, whilst the door is in closed position.

* * * * *